US006395459B1

(12) United States Patent
Taylor et al.

(10) Patent No.: US 6,395,459 B1
(45) Date of Patent: May 28, 2002

(54) METHOD OF FORMING A PROTECTIVE OVERCOAT FOR IMAGED ELEMENTS AND RELATED ARTICLES

(75) Inventors: Jeffrey F. Taylor, Mount Pleasant, PA (US); Thomas H. Whitesides; Hwei-Ling Yau, both of Rochester, NY (US); Elmer C. Flood, Canandaigua, NY (US); John W. Boettcher, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/676,865

(22) Filed: Sep. 29, 2000

(51) Int. Cl.[7] ..... G03C 1/76
(52) U.S. Cl. ..... 430/434
(58) Field of Search ..... 430/434

(56) References Cited

U.S. PATENT DOCUMENTS

| | | | | |
|---|---|---|---|---|
| 4,092,173 | A | 5/1978 | Novak et al. | 430/531 |
| 4,107,013 | A | 8/1978 | McGinniss et al. | 204/159.6 |
| 4,171,979 | A | 10/1979 | Novak et al. | 430/449 |
| 4,186,069 | A | 1/1980 | Muzyczko et al. | 430/175 |
| 4,333,998 | A | 6/1982 | Leszyk | 430/12 |
| 4,426,431 | A | 1/1984 | Harasta et al. | 430/14 |
| 4,587,169 | A | 5/1986 | Kistner | 428/413 |
| 4,619,949 | A | 10/1986 | Kistner | 522/170 |
| 5,695,920 | A | 12/1997 | Anderson et al. | 430/531 |
| 5,856,051 | A | 1/1999 | Yau et al. | 430/14 |

*Primary Examiner*—Hoa Van Le
(74) *Attorney, Agent, or Firm*—Chris P. Konkol

(57) ABSTRACT

The present invention relates to imaged elements having a protective overcoat that resists fingerprints, common stains, and spills. In particular, a curable overcoat composition is applied to an imaged element that contains a curing agent incorporated into a top layer of the element, resulting in a cured water-resistant or spill resistant overcoat. The invention can be used to protect photographic elements and recording media. In one embodiment of the invention, a UV-curable material and a water-dispersible latex is applied to a photographic print containing a photoinitiator incorporated into the original print.

21 Claims, No Drawings

METHOD OF FORMING A PROTECTIVE OVERCOAT FOR IMAGED ELEMENTS AND RELATED ARTICLES

FIELD OF THE INVENTION

The present invention relates to imaged elements having a protective overcoat that resists fingerprints, common stains, and spills. In particular, a curable overcoat composition is applied to an imaged element that contains a curing agent incorporated into a top layer of the imaged element, resulting in a cured water-resistant and/or stain resistant overcoat. The invention can be used to protect photographic elements and recording media.

BACKGROUND OF THE INVENTION

Gelatin has been used extensively in a variety of imaging elements as the binder because of its many unique and advantageous properties. For example, its property of water swellability allows processing chemistry to be carried out to form silver halide-based photographic images, and its hydrophilic nature allows gelatin to function as an ink-receiver in ink-jet recording media. However, due to this same property, imaging elements with exposed gelatin-containing materials, no matter if they are formed on transparent or reflective media, have to be handled with extreme care so as not to be in contact with any aqueous solutions that may damage the images. Accidental spillage of common household solutions such as coffee, punch, or even plain water can damage imaging elements such as ink-jet, electrophotographic, or photographic prints.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 3,190,197, 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. The application of UV-polymerizable monomers and oligomers on processed image followed by radiation exposure to form crosslinked protective layer is described in U.S. Pat. Nos. 4,092,173, 4,171,979, 4,333,998 and 4,426,431. Aqueous based materials to obtain a spill resistant protective overcoat have been disclosed in which aqueous dispersed particles when coated and dried coalesce into a uniform coating. See, for example, U.S. Pat. No. 5,376,434 to Ogawa et al. and U.S. Pat. No. 6,087,051 to Shoji et al.

In addition to a uniform coating, it may be advantageous to develop a level of crosslinking in an overcoat in order to build spill resistance and durability. One method for obtaining crosslinking is the use of molecules containing two or more reactive moieties (i.e., multifunctional molecules) that can be cured when exposed to high temperatures or actinic radiation. Various patents describe the use of actinic radiation to obtain a crosslinkable overcoat for photographic packages. For example, U.S. Pat. No. 4,092,173 to Novak et al. discloses an overcoat technology using UV curable or actinic radiation for curing. This patent describes an acrylated urethane polyfunctional acrylate ester which is applied to photographic elements for scratch resistance. U.S. Pat. No. 4,171,979 also to Novak et al. discloses an improvement upon U.S. Pat. No. 4,092,173 and includes repair of surface defects. U.S. Pat. No. 4,333,998 to Leszyk discloses an improvement upon U.S. Pat. No. 4,092,173 by the addition of a siloxycarbinol to the radiation curable composition.

U.S. Pat. No. 4,426,431 to Harasta et al. discloses a photocurable coating for restorative or protective treatment that uses a composition comprising a polymerizable epoxide, a polymerizable acrylic compound, catalyst, and a polymerizable organofunctional silane. The coating appears to involve a standard cationically initiated epoxy reaction. Other patents also disclose cationically initiated epoxy type systems. For example, EP 0 484 083 (1991) discloses triglycidyl ethers of trimethylol alkanes initiated with onium salts. U.S. Pat. Nos. 4,619,949 and 4,587,169 to Kistner disclose the use of an epoxy terminated silane and an aliphatic monomer epoxy resin, cationically initiated with an onium salt.

The UV-curable coatings described in the above-mentioned U.S. Pat. Nos. 4,619,949, U.S. Pat. No. 4,587,169, and in EP 0 484 083 (1991), where an epoxy based liquid overcoat containing a photoinitiator is coated to the surface of a photographic image, are neat monomer systems that are 100% monomer and photoinitiator. Prior to cure, they are liquids that are difficult to handle and may create a health hazard if handled incorrectly.

U.S. Pat. No. 4,107,013 to McGiniss et al. describes a paint comprising a high molecular weight aqueous latex solution combined with a low molecular weight photo-crosslinkable polymer. This composition has the advantage that heating of the coating to provide flow-out or leveling is eliminated. The low molecular weight crosslinker further provides flexibility and substrate adhesion while maintaining corrosion and wear resistance film characteristics. This patent does not disclose the use of such a coating for an imaging element, but is directed to improving the properties of a paint.

U.S. Pat. No. 4,186,069 to Muzyczko et al. discloses a latex solution with an incorporated photopolymerizable component. The system is described as a three-phase system prior to coating, including an aqueous phase, a latex phase, and a light-sensitive polymer phase. Upon coating, this system becomes a two-phase system consisting of a latex phase and a light-sensitive polymer phase. These systems are aimed at water developable lithographic printing plates.

It would be advantageous to have an overcoat composition that would provide protection for a photographic element, which overcoat could be applied to the imaged element quickly and economically. It is difficult, however, to coat a photographic element, because a coating composition that has good coating properties may not have good protective properties for an imaged element. It would be desirable to obtain a protective overcoat with the desired protective properties in the final product but which, at the same time, can be applied efficiently and economically in a photoprocessing setting, for example, as an adjunct to a conventional minilab operation. Not only for ease of handling, but for uniform coating properties, it would also be desirable for a curable coating composition to cure rapidly after it is applied to the substrate to be coated, but at the same time, not to cure prematurely, either during storage or before the film-forming has been completed. It would be desirable that any process for coating photographs or digital prints be robust in nature, not adversely sensitive to variations in the operating conditions.

SUMMARY OF THE INVENTION

The present invention is directed to a method of processing an imaged element to provide a cured overcoat that can protect the element from aqueous spills, fingerprints, and the like. It has been found that by the curing of a protective overcoats on an imaged element, improved performance is obtained with respect to durability, fingerprint resistance, and scratch resistance. The present invention generally involves two parts: (1) an imaged element that has incorporated in a top layer thereof a curing agent that will initiate crosslinking or that will initiate polymerization of a multifunctional monomer, and (2) an overcoat composition that when applied to the imaged element (in which the curing agent is incorporated) will crosslink, resulting in a superior spill resistant protective overcoat.

In one embodiment of the present invention, the imaged element is a photographic print comprising a support and at least one gelatin-based imaged layer. In a further embodiment, the protective overcoat overlying the gelatin-based imaged layer is the made from a composition comprising an aqueous dispersible latex and a curable component. In one particular embodiment, a photoinitiator is incorporated into a top layer of a photographic print.

Another aspect of the invention provides for a method of forming a water-resistant overcoat over an imaged element. In one particular embodiment, a photocurable overcoat composition is applied to the surface of a print that has an incorporated photoinitiator, and actinic radiation is used to activate the photoinitiator and cure the overcoat.

DESCRIPTION OF THE PREFERRED EMBODIMENTS

The present invention provides a simple and inexpensive way to improve the water, stain and abrasion resistance of processed imaged elements such as photographic prints. In accordance with the invention, the protective overcoat is applied over the imaged element after image formation, for example, after exposure and subsequent processing with respect to photographic prints. In particular, an overcoat formulation is applied to the emulsion side of photographic products, particularly photographic prints, or to ink-jet or thermal-dye (dye-sub) prints from digital electronic images derived from conventional film or based on digital images from a digital still camera (hereinafter referred to as "digital prints").

By the term "water-resistant" is meant herein that, after ordinary image processing, the imaged element does not imbibe water and has a protective overcoat that prevents or minimizes water-based stains from discoloring the imaged side of the imaged element.

As indicated above, the present invention involves the use of (1) an imaged element that has incorporated in a top layer thereof a curing agent that will initiate crosslinking or that will initiate polymerization of a multifunctional monomer, and (2) an overcoat composition that when applied to the imaged element (in which the curing agent is incorporated) will cure or crosslink, resulting in a superior spill resistant protective overcoat.

In one embodiment of the invention, the overcoat composition comprises (as a curable material) a polymerizable curing component in the form of a multifunctional monomer, including monomers, prepolymers, and macromonomers having more than one polymerizable ethylenic unsaturation in the molecule. In another embodiment of the invention, the overcoat composition comprises (as a curable material) a polymeric curing component, one or more crosslinkable polymers such as amino-formaldehyde resins, unblocked or blocked polyisocyanates, oxirane or epoxy-containing polymers, carboxylic acid-containing polymers or hydroxyl-containing polymers. Such crosslinkable polymers may be either be self-cured (such as a polymer containing both epoxy and hydroxy groups) or cured with such crosslinking agents as a multifunctional acid, alcohol or amine, or multivalent metal ions. Other crosslinkers that could be used include: aldehydes, dialdehydes or melamine formaldehydes such as dihydroxy dioxane, glyoxal, glutaraldehyde, methylolmelamine, di or polyfunctional isocyanates such as dicyclomethane diisocyanate, polyisocyanate based on hexamethylene diisocyanate (for example Desmodur® N3300 from Bayer), anhydrides such as phthalic anhydride, maleic anhydride and its derivatives including polymers such as poly(maleic anhydride-co-styrene), di or polyfunctional aziridines such as Xama-7®, a polyfunctional aziridine from Cordova Chem, vinyl sulfones such as bisvinylsulfonyl methane, di or polyfunctional epoxies such as diepoxydecane, diepoxyoctane or Epon® resins from Shell Oil, metal alkoxides such as trimethyl borate, tetraethylorthosilicate, or titanium tetrabutoxide, and metal salts such as zinc acetate or aluminum acetate.

In still another embodiment of the invention, the coating composition can comprise an non-curable aqueous latex in combination with a curable material, such as a polymerizable curing component. This polymerizable curing component is preferably in the form of at least one multifunctional monomer that will be absorbed or loaded into the latex phase and that forms a crosslinked structure on curing. This two phase solution, an aqueous phase and a loaded latex phase, can then be coated onto an imaged element such as a photographic print and dried, thereby forming a uniform coating. In still another embodiment of the invention, the non-curable aqueous latex solution may be used in combination with a polymeric curing component. Alternately, a polymeric curing component can be in the form of a latex. In a preferred embodiment of the invention, the overcoat composition applied to the imaged element comprises a dry laydown of at least 0.54 $g/m^2$(50 $mg/ft^2$) made from an overcoat formulation comprising water-dispersible latex particles in the form of particles have an average particle size of 10 to 250 nm, a photopolymerizable component system comprising copolymerizable compatible monomers, at least one of which monomers is a multifunctional monomer having more than one polymerizable ethylenic unsaturation, wherein the Tg of the coated composition comprising the latex particles and the photopolymerizable component system prior to crosslinking is −60 to 60° C. Suitably, the overcoat composition applied to the imaged element to form the protective overcoat comprises 5 to 75% water, preferably 10 to 50% by weight of the total composition.

In any case, after coating the imaged element with an overcoat composition comprising a curable material or system according to the present invention, the curing agent in the underlying layer of the photographic element can diffuse into the overcoat to cure or crosslink the curable component. In some cases, an additional means or step such as exposure to actinic radiation or heat may be required or optional for promoting diffusion and/or to initiating the curing reaction.

In one embodiment, involving a photoinitiated system, a photoinitiator is incorporated into a top layer of a photographic print such that the photoinitiator can effectively diffuse to the surface of the element. After a curable overcoat composition is applied to the surface of the print that has the incorporated photoinitiator, actinic radiation is used to activate the photoinitiator and cure the overcoat. Optionally, the photoinitiator may be incorporated into a gelatin coating on photographic paper by loading the photoinitiator into a latex particle, mixing the loaded latex with gelatin, and coating the resulting dispersion onto the photographic paper. This process can be carried out by forming an aqueous mixture of photoinitiator, latex, and surfactant. Upon mixing, the photoinitiator will prefer the latex environment compared to the aqueous environment, resulting in a latex particle swollen with photoinitiator or catalyst. Another method of incorporating the photoinitiator is to prepare a conventional surfactant-stabilized dispersion in gelatin. A particularly preferred method is that described in U.S. Pat. No. 5,468,604, in which a hydrophobic additive is used to stabilize the dispersion against ripening.

In this embodiment, then, a loaded latex or gelatin-stabilized emulsion containing the photoinitiator can then be incorporated into the top gelatin layer or other topcoat of a photographic paper. When a photocurable material is applied to the photoinitiator loaded topcoat, and exposed to UV light or other form of radiation, a cured durable overcoat is produced. It will be understood that, in other embodiments, when the overcoated material is some other kind of material that crosslinks in the presence of some other kind of curing agent incorporated into the overcoat, an appropriate means (heat, exposure to an activating atmosphere or solution, or other means) of inducing crosslinking may be used.

Monomers that can be used herein to comprise a curable material may be any molecule that may be polymerized or copolymerized to effect curing. Preferable monomer systems would be multifunctional acrylates and mixtures thereof with any vinyl containing compound that can be initiated, particularly in the case of a photoinitiated process, by a free radical source such as a benzophenone, benzoin or benzoin ether compound. Multifunctional acrylates are preferred. Additionally, an epoxy containing multifunctional compound, including oligomers or prepolymers, may be used which can be ionically initiated using a cation generating source such as an onium ion containing compound.

The term "curing agent" is meant to include photoinitiators, catalysts, sensitizers, or other compounds that will initiate crosslinking or that will initiate polymerization of a multifunctional monomer. For example, photoinitiators used to initiate light-induced radical polymerization include photodecomposition products of carbonyl compounds such as di-tert-butyl ketone and 2-hydroxy-2-methyl propiophenone, azo compounds such as 2.2'-azobis (isobutyronitrile), hydrazines such as tetraphenylhydrazine and peroxides such as di-benzoyl peroxide. Photoinitiators of the radical polymerization variety may also be polymeric as in the case of polymers bearing pendant benzophenone moieties. In addition to organic photoinitiators, one can also use organometallic complexes such as titanocene and various (cyclopentadienyl)(arene)iron(II) salts. Compounds including derivatives of acetophenone, anthraquinone and benzoin are useful as water-soluble photoinitiators for aqueous curable systems. Compounds useful for cationic photoinitation include onium salts such as diaryliodonium, triarylsulfonium and ferrocenium salts. For the purposes of efficient utilization of light sources, worker safety and economy, it is useful to extend the sensitivity of photoiniator systems to wavelengths longer than the ultraviolet region. For this purpose, dyes or sensitizers are used, including acridines, oxazines, thiazines, xanthenes, cyanines and merocyanines.

With respect to photographic applications, the curing agent should have a logP such that even if a substantial portion of the curing agent washes out in water during photoprocessing, a sufficient amount remains to be effective. The water-solubility (or logP) of the curing agent or photoinitiator should not be so high (or in the case of LogP so low) that all of it is washed out in processing before effectively curing the curable material. On the other hand, the water-solubility (or logP) of the curing agent or photoinitiator should not be so low (or in the case of LogP, so high) that it would not migrate well enough into the overcoat to be effective. Thus, in one embodiment of the invention the curing agent or photoinitiator preferably has a water solubility as measured by the logP between 3 and 12, more preferably between 4 and 11, and most preferably between 4 and 9. The logP is the calculated value of the octanol-water partition coefficient, calculated by the method of Viswanadhan, et al., as described in M. Reinhard and A. Drefahl, "Toolkit for Estimating Physicochemical Properties of Organic Compounds", Wiley-Interscience, New York, 1999. The logP value is a well accepted measure of hydrophobicity (and therefore water solubility) in the biological and chemical literature.

Examples of logP values for various curing agents are HMP (1.54), benzoin (2.81), BME (3.05), BEE (3.39), BIBE (4.26). Regarding uses of the present invention that do not involve aqueous processing, such as ink-jet printing, the high end of the logP ranges still apply, since the curing agent still has to move from one layer to another. The examples below show that it helps to swell the gelatin in the overcoat with water, suggesting an upper limit on the hydrophobicity of the curing agent for the purpose of effecting mobility. This can depend, however, on the time allowed for curing.

Examples of multifunctional monomers include monomers such as 1,3-butylene glycol dimethacrylate; ethylene glycol diacrylate; ethylene glycol dimethacrylate; Bisphenol-A-dimethacrylate; diethylene glycol dimethacrylate; pentaerythritol triacrylate; pentaerythritol tetraacrylate; triethylene glycol dimethacrylate; trimethylol propane trimethacrylate; trimethylene glycol dimethacrylate; trimethylol propane triacrylate; tetraethylene glycol diacrylate; ethoxylated Bisphenol-A-dimethacrylate; pentaerythritol tetramethacrylate; allyl acrylate; allyl crotonate; allyl methacrylate; diallyl acrylate; diallyl fumarate; diallyl malate; diallyl maleate; diallyl methalate; diallyl-oxyethyl methacrylate; melamine acrylate; triallyl-5-triazine; vinyl trialloxy silane; triallyl cyanurate; 1,6-hexanediol diacrylate; divinyl benzene; diallyl amine; trimethylol propane dimethyl ether; diallyl malate methacrylate; and dihydroxyethylphthalate. The preferred multifunctional monomer is pentaerythritol tetraacrylate.

In general, the amount of curing agent incorporated in the imaged element will vary, depending on the amount of curable material and the type of curing reaction. For example, in the embodiment of the invention comprising a hydrophobic polymer latex loaded with a UV-curable monomer composition, the monomer composition could range between 20 to 300 wt. % with respect to the hydrophobic polymer, and would preferably range between 50 to 200 wt. %, with respect to the hydrophobic polymer (1:2 to 2:1 weight ratio). In general the curing agent or photoinitiator composition incorporated into an imaged element could range between 1 to 30 wt. % with respect to the curable material in the overcoat and would preferably range between 5 to 15 wt. %. Preferably, for embodiments involving a curable polymer, the amount of curing agent incorporated into the photographic element could range between 5 to 30%, preferably 10 to 25% with respect to the curable polymer.

In the case of overcoat compositions comprising dispersions of hydrophobic polymers, latexes or hydrophobic polymers of any composition that can be stabilized in a water-based medium, the hydrophobic polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived form them, unsaturated nitrites, vinyl alcohols, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, suspension polymerization, dispersion polymerization, and other polymerization methods known in the art of polymerization. Optionally, latex particles in a coating composition in accordance with the invention can also contain suitable crosslinking agents for crosslinking the water-dispersible polymer during preparation. The selection of water-dispersible particles to be used in the overcoat is based on the material properties one wishes to have as the protective overcoat in addition to water resistance.

Preferred latex polymers are polymers obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

To form a latex, the latex monomer solution may be dispersed in water using techniques well known in the art, including emulsion polymerization or solution polymerization technique. Emulsion polymerization is preferred. Emulsion polymerization is well known in the art and is described, for example, in J. L. Gardon, "Emulsion Polymerization", Chapter 6 in "Polymerization Processes" edited by C. E. Schildknecht and I. Skeist, published by Wiley and Sons, Inc. New York, 1977. Examples of the chemical initiators which may be used include a thermally decomposable initiator, for example, a persulfate (such as ammonium persulfate, potassium persulfate, sodium persulfate), hydrogen peroxide, 4,4'-azobis(4-cyanovaleric acid), and redox initiators such as hydrogen peroxide-iron (II) salt, potassium persulfate-sodium hydrogensulfate, potassium persulfate-sodium metabisulfite, potassium persulfate-sodium hydrogen bisulfite, cerium salt-alcohol, etc. Emulsifiers which may be used in the emulsion polymerization include soap, a sulfonate(for example, sodium N-methyl-N-oleoyltaurate, sodium dodecylbenzene sulfonate alpha-olefin sulfonate, diphenyloxide disulfonate, naphthalene sulfonate, sulfosuccinates and sulfosuccinamates, polyether sulfonate, alkyl polyether sulfonate, alkylarylpolyether sulfonate, etc.), a sulfate (for example, sodium dodecyl sulfate), a phosphate (for example, nonylphenol ethoxylate phosphate, linear alcohol alkoxylate phosphate, alkylphenol ethoxylate phosphate, phenol ethoxylate), a cationic compound (for example, cetyl trimethylammonium bromide, hexadecyl trimethylammonium bromide, etc.), an amphoteric compound and a high molecular weight protective colloid(for example, polyvinyl alcohol, polyacrylic acid, gelatin, etc.). Specific examples and functions of the emulsifiers are described in J. L. Gardon, "Emulsion Polymerization", Chapter 6 in "Polymerization Processes" edited by C. E. Schildknecht and I. Skeist, published by Wiley and Sons, Inc., New York, 1977 and references contained therein. Common chain transfer agents or mixtures thereof known in the art, such as alkylmercaptans, can be used to control the polymer molecular weight. As mentioned above, the latex can be curable if desired by, for example adding suitable crosslinking agents for crosslinking the functional groups such as acid groups in the polymer material. Such an additive can also improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered.

In accordance with the invention, an imaged element such as a photographic element can be provided with a protective overcoat by applying the overcoat composition after development, in the case of a photographic print, or after printing, in the case of an ink-jet or other digital print. The application, drying, and curing of the protective overcoat on an imaged element can be accomplished, for example, by any of the methods described in commonly assigned U.S. Pat. No. 5,984,539, herein incorporated by reference in its entirety. A preferred method of application, drying, and curing is shown in FIG. 16A of the latter patent. As indicated above, the properties of the protective overcoat on the imaged element are enhanced by the crosslinking of the photopolymerizable component system in the overcoat by means of actinic radiation.

In one embodiment, a photographic element according to the present invention comprises: (a) a support; (b) at least one silver-halide emulsion layer superposed on a side of said support; and (c) overlying the silver emulsion layer, a protective overcoat having a dry laydown of at least 0.54

$g/m^2$ (50 $mg/ft^2$) made from an overcoat formulation comprising 0.45 to 6.0 $g/m^2$ (about 45 to 600 $mg/ft^2$) dry laydown of water-dispersible latex particles in the form of particles have an average particle size of 10 to 250 nm, and a photopolymerizable component system comprising 20 to 300 weight percent, with respect to the hydrophobic polymer, of copolymerizable compatible monomers, at least one of which monomers is a multifunctional monomer having more than one polymerizable ethylenic unsaturation, wherein the Tg of the coated composition comprising the latex particles and the photopolymerizable component system prior to crosslinking is −60 to 60° C., preferably −20 to 30° C.

The protective overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the imaged elements in accordance with this invention, the water-dispersible polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as camauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874, 205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008. Preferably, a commercial embodiment involve simultaneous co-extrusion.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Imaged elements protected in accordance with this invention may be photographic elements that differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978). Because of the amount of handling that can occur with paper prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a protective overcoat having the above described coating composition overlying the silver halide emulsion layer superposed on a support. The photographic element, after image-wise exposure, is developed in an alkaline developer solution having a pH greater than 7, preferably greater than 8, more preferably greater than 9. The protective overcoat may be applied after development. The application, drying, and curing of the protective overcoat on an imaged element can be accomplished, for example, by any of the methods described in commonly assigned U.S. Pat. No. 5,984,539, herein incorporated by reference in its entirety. A preferred method of application, drying, and curing is shown in FIG. 16A of the latter patent.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention also applies to imaged recording elements in which the images, for example, are derived from a pixel-based picture made with a digital still camera. The image can be formed in one or more recording layers, for example as produced using ink-jet printing or electrophotographic printing. Ink-jet printing technology is reviewed in an article titled "Progress and Trends in Ink-Jet Printing Technology" by Hue P. Le in the Journal of Imaging Science and Technology, Volume 42, Number 1 (January/February 1998), pp. 49–61. Essentially, ink droplets, typically in the volume range 1–100 picoliters, are ejected from a printhead to a receiver material on which the image is formed. The ink-jet printhead may be of the continuous or drop-on-demand varieties. Several physical mechanisms for drop ejection are known, but the currently most popular among these are thermal and piezoelectric. In the thermal mechanism, ink in the printhead is heated to form a water vapor bubble that expels one or more ink droplets out of the printhead toward the receiver. Representative thermal ink-jet printheads are described in, for example, U.S. Pat. No. 4,723,129 of Endo et al. (Canon) and U.S. Pat No. 4,490,728 of Vaught et al. (Hewlett Packard). In the piezoelectric mechanism, one or more droplets are expelled from the printhead by a physical deformation that accompanies a voltage change across a piezoelectric material forming a part of the printhead structure. Representative piezoelectric printheads are described in, for example, U.S. Pat. No. 4,459,601 of Howkins (Exxon) and U.S. Pat. No. 5,563,634 of Masahiro et al. (Seiko Epson).

The carrier for the ink-jet inks may be comprised solely of water or can be predominantly water mixed with water soluble solvents such as polyhydric alcohols or can be predominantly organic materials such as polyhydric alcohols. The dyes used in such compositions are typically water-soluble direct or acid type dyes. Such liquid ink compositions have been described extensively in the prior art, including, for example, U.S. Pat. No. 4,781,758.

In addition to water and one or more colorants, such as dyes or pigments, an aqueous ink typically contains one or more humectants, which affect ink viscosity and volatility, one or more surfactants, which affect the wetting and penetrating properties of the ink, and a biocide, which extends the useful life of the ink. Aqueous inks may also contain many other ingredients, including metal ion chelating agents, pH buffers, defoamers, and dispersing agents. It is well known to improve the tone scale or bit depth of an image by using more than one ink density for each color. Representative ink-jet inks are described in, for example, U.S. Pat. No. 5,571,850 of Ma et al. (DuPont), U.S. Pat. No. 5, 560,770 of Yatake (Seiko Epson), and U.S. Pat. No. 5,738,716 of Santilli et al. (Eastman Kodak).

Ink-jet media or receivers may be reflective, transparent, or of intermediate transparency (e.g., for day/night display materials). At minimum, an ink-jet receiver includes a support and an ink receiving layer. The simplest ink-jet receiver is plain paper, in which these two functions are combined. As a practical matter, more complex receiver structures are required for improved image quality and physical properties. Specifically formulated ink receiving layers coated on paper or other supports improve color density and dot resolution. Receiver composition and structure may also be modified to improve properties such as wettability, ink absorptivity, drying time, gloss, reduced image artifacts, waterfastness, and light and dark stability. Representative ink-jet receiver structures and compositions are described in, for example, U.S. Pat. No. 4,954,395 of Hasegawa et al. (Canon), U.S. Pat. No. 5,725,961 of Ozawa et al. (Seiko Epson), and U.S. Pat. No. 5,605,750 of Romano et al. (Eastman Kodak).

The use of the present invention in the context of typical recording elements will now be described in more detail. Any support or substrate may be used in a recording element, for example, plain or calendered paper, paper coated with protective polyolefin layers, polymeric films such as poly(ethylene terephthalate), poly(ethylene naphthalate), poly(1,4-cyclohexane dimethylene terephthalate), polyvinyl chloride, polyimide, polycarbonate, polystyrene, or cellulose esters. In particular, polyethylene-coated paper or poly(ethylene terephthalate) is preferred.

The support is suitably of a thickness of from about 50 to about 800 $\mu$um, preferably from about 75 to 500 $\mu$m. Therefore, on page 19 (on the original draft), the range should be 50 to 800 um, preferably 75 to 500 um. Antioxidants, antistatic agents, plasticizers, dyes, pigments and other known additives may be incorporated into the support, if desired.

In order to improve the adhesion of the image-recording layer to the support, the surface of the support may be optionally subjected to a corona-discharge treatment prior to applying the image-recording layer.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 5 percent by weight of the binder component and the average particle size of the filler material is in the range of 5 to 30 $\mu$m. Typical binders used in the backing layer are polymers such as acrylates, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octyl-sulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

Preferably, the support in a recording element is coated with an image forming layer or layers of materials capable of absorbing the carrier and/or dyes in the ink. The thickness of this layer is typically from 5 to 50 micrometers ($\mu$m). The material may include a hydrophilic polymer, including naturally-occurring hydrophilic colloids and gums such as gelatin, albumin, guar, xantham, acacia, chitosan, starches and their derivatives, functionalized proteins, functionalized gums and starches, and cellulose ethers and their derivatives, polyvinyloxazoline and polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers. Poly(vinyl alcohol) and its derivatives are preferred hydrophilic absorbing materials for use in ink receptive coatings. This layer may also comprise a microporous material. Preferred microporous materials are silica, alumina, or hydrated alumina, boehmite, mica, montmorillonite, kaolite,talc, vermiculite, zeolites, calcium silicate, titanium oxide, barium sulfate, and the like, optionally in combination with a polymeric binder. See, for example, U.S. Pat. No. 5,605,750, incorporated by reference. Many known microporous materials may be employed, including for example, those described in U.S. Pat. Nos. 5,032,450; 5,035,886, 5,071,645, and 5,14,438.

For higher quality ink-jet media, a separate upper image-forming layer may be formed above a carrier-absorbing layer. Accordingly, when the ink is ejected from the nozzle of the ink-jet printer in the form of individual droplets, the droplets pass through the upper layer where most of the dyes or pigments in the ink are retained or mordanted while the remaining dyes/pigments and the carrier portion of the ink pass freely through the upper layer to the carrier-absorbing layer where they are rapidly absorbed, for example, by a hydrophilic polymer and/or microporous material. In this manner, large volumes of ink are quickly absorbed by the recording elements, giving rise to high quality recorded images having excellent optical density and good color gamut.

Image-forming layers in recording elements can also incorporate various known additives, including matting agents such as titanium dioxide, zinc oxide, silica, and polymeric beads such as polystyrene beads for the purposes of contributing to the non-blocking characteristics of the recording elements and to control the smudge resistance thereof; surfactants for improving the aging behavior of the ink-absorbing resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; dye-fixing agents; viscosity modifiers; waterproofing agents; dispersing agents; UV absorbing agents; mordants, and the like.

If desired, in addition to a coating according to the present invention, the recording element can be further coated with an ink-permeable, anti-tack, ink receptive coating, such as, for example, a hydrophilic cellulose derivative such as methyl cellulose, ethyl cellulose, hydroxyethyl cellulose, hydroxypropyl cellulose, sodium carboxymethyl cellulose, calcium carboxymethyl cellulose, methyethyl cellulose, methylhydroxyethyl cellulose, hydroxypropylmethyl cellulose, hydroxybutylmethyl cellulose, ethylhydroxyethyl cellulose, sodium carboxymethylhydroxyethyl cellulose, carboxymethylethyl cellulose, hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide; as well as hydroxyethyl cellulose grafted with alkyl C12–C14 chains.

The present invention is illustrated by the following examples. Unless otherwise indicated, the molecular weights herein are weight average molecular weights, as determined by size exclusion chromatography described below.

EXAMPLES

Assessment of Overcoat Performance

Test for Degree of Cure:

Since the coatings were initially liquid, the degree of cure could be qualitatively established by observing the transition from liquid to highly crosslinked, durable solid. Intermediate stages of cure corresponded to varying degrees of resistance to scratching in a simple scratch test, performed by rubbing the sample with a wooden dowel (radius=ca. 0.5 mm), using no load other than the weight of the dowel. The condition after scratching was observed visually, and rank-ordered using the following system:

A: sample was fully cured and showed no mark of any kind.

B: sample was solid, but showed barely visible marks under the conditions of the test.

C: sample was solid, but was heavily damaged, showing easily visible marks.

D: sample was semi-solid or tacky; the coating was heavily damaged or removed.

NC: no curing; the sample was liquid.

A ranking of A is most desirable, and B is acceptable. The other rankings are unacceptable.

Test for Water Resistance:

Ponceau red dye is known to stain gelatin through ionic interaction. Ponceau red dye solution was prepared by dissolving 1.0 g of dye in 1000 grams of a mixture of 5 wt. % acetic acid in water. A drop of the dye solution was placed on the surface of the coated and cured sample. After 10 minutes, the excess dye solution was removed using a clean cotton cloth. The performance of the overcoat was evaluated by visually ranking the degree to which the coating was stained by the dye according to the following scheme:

A: No mark or red stain. A ranking of "A" is most desirable.

B: Some lines or speckles of red are visible.

C: Outline of spot visible.

D: dark red; no protection.

A ranking of A is most desirable, B is acceptable, and C and D show poor or no protection.

Test for Wiping Damage:

The resistance of the overcoat to damage upon wiping was evaluated by examining the area tested as described above for water resistance. In particular, any scratching damage that occurred when the excess dye solution was removed by wiping with a clean cotton cloth was noted, and visually ranked according to the following scheme:

A: No scratching was visible as a result of wiping.

B: A moderate number and severity of scratches was visible.

C: An extensive number and severity of scratches was visible after wiping.

Test for Fingerprint Resistance:

The resistance of the overcoat to marking by fingerprinting was evaluated using synthetic mixture designed to mimic skin oil ("Thermaderm"). This mixture was prepared using the components of Table 1 as follows:

TABLE 1

| | Amount |
|---|---|
| Non-aqueous phase | |
| Corn oil | 78.96 grams |
| Mineral oil | 25.26 grams |
| Glycerin | 52.64 grams |
| Stearyl alcohol | 15.79 grams |
| Oleic acid | 63.16 grams |
| Sorbitan monooleate | 21.05 grams |
| Cetyl palmitate | 6.32 grams |
| Oleyl alcohol | 6.32 grams |
| Stearic acid | 31.58 grams |
| Lexemul ® AR Glyceryl Stearate (Inolex Chemical Co., Philadelphia, PA 19148) | 47.36 grams |
| Cholesterol | 9.47 grams |
| Methylparaben | 4.21 grams |
| Butyl paraben | 3.16 grams |
| Butylated hydroxytoluene | 0.21 grams |
| Butylated hydroxyanisole | 0.21 grams |
| Vitamin E acetate | 0.13 grams |
| Cetyl alcohol | 15.79 grams |
| Squalene | 15.79 grams |
| Aqueous Phase | |
| Pegosperse ® 1750 MS-K Surfactant | 31.58 grams |
| Distilled water | 571.01 grams |

The water-insoluble components were combined and warmed using a water bath to a homogeneous solution. The aqueous phase was also warmed to dissolve the surfactant, Pegosperse® an ethoxylated fatty acid sold by Glyco Chemicals, Inc. The aqueous phase was quickly added to the non-aqueous phase with vigorous agitation. The resultant suspension was then partially emulsified with a high-shear mixer for approximately 5 minutes. Complete emulsification was accomplished by processing through a high-pressure homogenizer. After preparation, the material was stored in a tightly sealed container and frozen, removing small quantities as needed for testing.

The thermaderm mixture was applied to the surface of the protective overcoat by smearing a small drop of thermaderm over an area of about 1 $cm^2$. The sample was allowed to stand for 24 hours under ambient conditions and then wiped with a cotton cloth. Each coating was rated according to the following scheme.

A: No mark or fingerprint was observed.

B: Barely visible marking or swelling of the overcoat was observed.

C: An obvious fingerprint mark was observed and the coating was somewhat damaged on wiping.

D: The protective overcoat layer was highly swollen or dissolved, and removed by wiping.

A ranking of "A" is most desirable, "B" is acceptable, and "C" and "D" are not acceptable at all.

Example 1

Preparation of Photoinitiator-loaded Latex Dispersion Using 2-hydroxy-2-mnethyl Propiophenone (HMP) (Dispersion DI)

A mixture was prepared of 24.07 grams of 2-hydroxy-2-methyl propiophenone (Aldrich), 20.02 grams of a 10 wt. % solution of SURF-1 surfactant, 116.01 grams de-ionized water. This suspension was sonicated for 4 minutes. To this solution was added 40.0 grams of polymer P1. Polymer P1 was a butyl acrylate/2-acrylamido-2-methylpropane sulfonic acid/2-acetoacetoxyethyl methacrylate (90:4:6 weight ratio) latex polymer (20% solution of latex particles). This solution was stirred with a magnetic stir bar for 4 hours, and then used to prepared melts for coating as described below.

Preparation of Photoinitiator-loaded Latex Using Benzoin Methyl Ether (BME) (Dispersion D2)

A mixture was prepared of 12 grams of BME (Aldrich Chem. Co.), 15 grams of a 10 wt. % solution of SURF-1 surfactant, 53 grams de-ionized water. This solution was sonicated for 4 minutes. To the dispersed suspension was added 20 grams of P1. This solution was stirred with a magnetic stirring bar for 4 hours, and then used to prepared melts for coating as described below.

Preparation of Photoinitiator-loaded Latex Using Benzoin Isobutyl Ether (BIBE) (Dispersion D3)

A mixture was prepared of 32 grams of BIBE (Aldrich), 40 grams of a 10 wt. % solution SURF-1, 141 grams de-ionized water. This solution was sonicated for 6 minutes. To the dispersed suspension was added 53.5 grams of P1. This suspension was allowed to stand in a constant temperature bath for 30 minutes at 45° C. Then, 134 grams of a warm solution of 11.6% Type IV photographic gelatin in water was added, together with a magnetic stirring bar. The suspension was stirred magnetically for about one hour, stored overnight in the refrigerator, and used to prepare coating melts as described below.

Preparation of a Dispersion of BIBE Stabilized with Diundecyl Phthalate (Dispersion D4)

A mixture of 26.1 g BIBE and 2.91 g diundecyl phthalate was poured into a solution comprised of 32.6 g of 10 wt. % SURF-1., 141.2 g 11.6% Type IV photographic gelatin, and 124.2 g of water. The mixture was shaken well and then passed through a colloid mill six times. Microscopic examination of the resulting suspension showed particles that were less than 1 micron in size. This dispersion was stored as with Dispersion D3, and used to prepare coating melts as described below.

Preparation of Coatings with Incorporated Photoinitiator

A color photographic paper imaging element (Substrate S1) was prepared on a coating machine. The schematic structure is shown below:

| Layer | Laydown (mg/sq.ft.) |
|---|---|
| UV-absorbing Layer | 12.11 UV-1 |
| | 2.13 UV-2 |
| | 3.57 SCV-1 |
| | 2.37 S-1 |
| | 2.37 S-2 |
| | 47.5 Gelatin |
| Cyan | 18.1 Red light sensitive AgX |
| | 39.31 C-1 |
| | 38.52 S-2 |
| | 3.22 S-3 |
| | 25.31 UV-1 |
| | 129.0 Gelatin |
| UV | 17.43 UV-1 |
| | 3.07 UV-2 |
| | 5.14 SCV-1 |
| | 3.41 S-1 |
| | 3.41 S-2 |
| | 68.4 Gelatin |
| Magenta | 7.70 Green-light sensitive AgX |
| | 1.11 KCL |
| | 29.5 C-2 |
| | 8.26 S-2 |
| | 3.54 S-4 |
| | 17.7 ST-1 |
| | 2.01 ST-2 |
| | 57.0 ST-3 |
| | 0.05 FOG-1 |
| | 0.285 Nitric Acid |
| | 117.0 Gelatin |
| IL | 6.12 SCV-1 |
| | 18.4 S-2 |
| | 6.025 3,5-Disulfocatechol disodium salt |
| | 0.524 Nitric Acid |
| | 0.18 SURF-1 |
| | 70.0 Gelatin |
| Yellow | 24.0 Blue-light sensitive AgX |
| | 45.0 C-3 |
| | 45.0 P-1 |
| | 20.3 S-2 |
| | 0.88 SCV-2 |
| | 141.8 Gelatin |
| C-1 | Butanamide 2-[2,4-bis(1,1-dimethylpropyl)phenoxy] -N-(3,5-dichloro-4-ethyl-2-hydroxyphenyl) |
| C-2 | 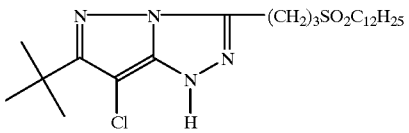 |
| C-3 | 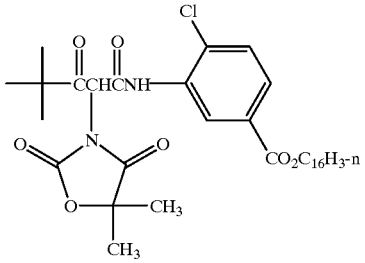 |

-continued

| Layer | Laydown (mg/sq.ft.) |
|---|---|
| FOG-1 | 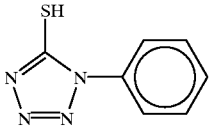 |
| HAR-1 | 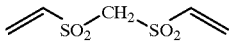 |
| P-1 | 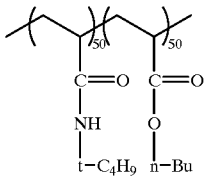 |
| S- 1 | 1,4-Cyclohexylenedimethylene bis(2-ethylhexaneoate) |
| S-2 | 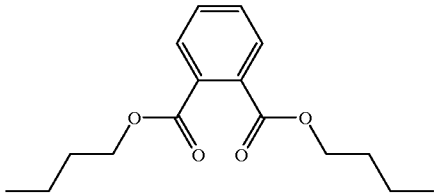 |
| S-3 | 2-(2-Butoxyethoxy)ethyl acetate |
| S-4 | Di-undecylphthalate |
| SCV-1 | 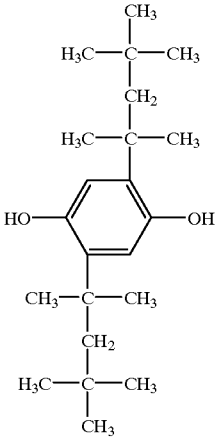 |
| SCV-2 | benzenesulfonic acid 2,5-dihydroxy-4-(1-methylheptadecyl)-mono-potassium salt |
| ST-1 | 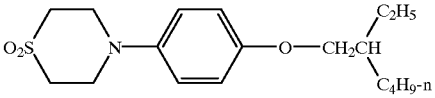 |
| ST-2 | 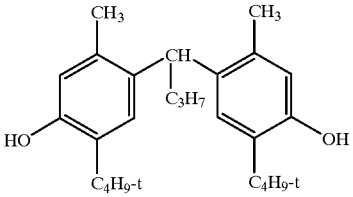 |

-continued

| Layer | Laydown (mg/sq.ft.) |
|---|---|
| ST-3 | 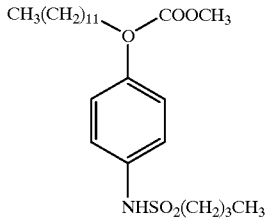 |
| SURF-1 | 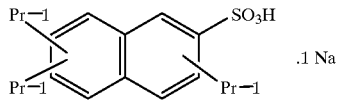 |
| SURF-2 | $C_8F_{17}SO_3N(C_2H_5)_4$ |
| UV-1 | 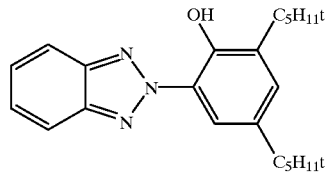 |
| UV-2 | 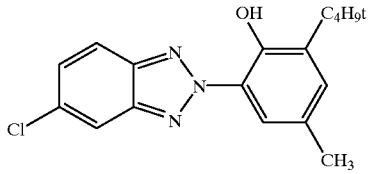 |

Photographic paper support
sublayer 1: resin coat (Titanox and optic brightener in polyethylene)
sublayer 2: paper
sublayer 3: resin coat (polyethylene)

Melts were prepared by combining a specified amount of gelatin, de-ionized water, and HMP-loaded latex dispersion D1. The amounts were chosen to yield a final topcoat (initiator-containing) composition as in described in Table 2 below. The gelatin solutions were melted and stirred using a magnetic stirrer and hot plate. A chemical hardener solution was also prepared, which could be combined with the sample melt upon coating to yield the desired coating composition. The chemical hardener was bis-vinyl sulfonyl methane (BVSM).

The gelatin melts and hardener solutions were mixed and coated on the above stated color paper rug using an experimental coating machine equipped with an extrusion hopper. Three topcoats were prepared, using different levels of gelatin and photoinitiator. The coating laydowns for the coatings of Example 1 were those indicated in Table 2. Coating C1 is a control, having no photoinitiator, and coatings C2 and C3 are coatings of the invention.

TABLE 2

| Topcoat Sample No. | Gelatin laydown ($mg/ft^2$) | Photoinitiator (HMP) laydown ($mg/ft^2$) | Hardener (BVSM) (wt % of total gelatin) |
|---|---|---|---|
| C1 | 300 | 0 | 1.5 |
| C2 | 207 | 208 | 1.9 |
| C3 | 207 | 360 | 2.3 |

Protective Overcoat Formulations

Three protective overcoat formulations were prepared by dissolving pentaerythritol tetraacrylate (Aldrich) in various mixtures of isopropanol and de-ionized water. The photocurable formulation compositions are listed in Table 3. The solutions were protected from exposure to room light by using brown-glass containers.

TABLE 3

| Sample No. | Pentaerythritol-tetraacrylate wt. % | Isopropanol wt. % | De-ionized water wt. % |
|---|---|---|---|
| F1 | 50 | 50 | 0 |
| F2 | 25 | 50 | 25 |
| F3 | 43.75 | 43.75 | 12.5 |

Example 2

Formulation F1 as described previously was coated onto approximately 4 inch-square samples of substrates C1, C2, and C3 using a Headway Research® spin-coating device, at a spin speed of 3000 revolutions per minute and a spin-off time of 30 seconds. The coated samples were cured by exposure to ultraviolet light using a Fusion Systems® UV cure apparatus, equipped with a medium pressure mercury arc lamp. The ultraviolet dosage was set for 300 $mJ/cm^2$. The time between coating application and cure was varied between 0 and 20 minutes. The results of the evaluation of overcoats are given in Table 4:

TABLE 4

| Coating No. + Overcoat No. | Time before curing (min) | Degree of Cure |
|---|---|---|
| C1 + F1 (no HMP) (control) | 0 | NC |
| | 5 | NC |
| | 10 | NC |
| | 20 | NC |
| C2 + F1 (invention) | 0 | NC |
| | 5 | NC |
| | 10 | D |
| | 20 | C |
| C3 + F1 (invention) | 0 | NC |
| | 5 | NC |
| | 10 | C |
| | 20 | C |

When the photocrosslinkable monomer was applied over a coating (C1) that comprised no photoinitiator, no cure of the monomer was obtained even after long standing. In contrast, in the coatings of the invention (C2 and C3), where a photoinitiator was incorporated into the top gelatin layer, on standing sufficient photoinitiator diffused into the applied overcoat so that crosslinking could occur on exposure to actinic radiation. The diffusion time with formulation F1, which comprised no water to swell the gelatin in the coating, was relatively slow, so that even after 20 minutes, the curing was only partially complete.

In a second experiment, each formulation F1–F3 was applied over each of the coatings C1–C3. After 20 minutes, the samples were cured as described above. The overcoat was evaluated for degree of cure, water (stain) resistance, and fingerprint resistance, with the results of the evaluation of the overcoats in the second experiment shown in Table 5.

TABLE 5

| Coating No. | Over-coat No. | | Degree of cure | Water (stain) resistance | Fingerprint resistance |
|---|---|---|---|---|---|
| C1 (gelatin only) | none | Control | N/A* | D | C |
| | F1 | " | NC | not evaluated | ** |
| | F2 | " | NC | D | ** |
| | F3 | " | NC | D | ** |
| C2 (208 mg/ft$^2$ HMP) | F1 | Invention | C | not evaluated | not evaluated |
| | F2 | " | A | A | A |
| | F3 | " | D | A | ** |
| C3 (360 mg/ft$^2$ HMP) | F1 | invention | C | not evaluated | not evaluated |
| | F2 | " | A | A | A |
| | F3 | " | A | A | A |

*N/A: test not applicable; no overcoat
** overcoat liquid or too tacky to evaluate fingerprinting In this experiment, Formulations F2 and F3, both containing water, give substantially better results than Formulation F1; a hard coating with excellent protection against both water-based stains and fingerprinting may be obtained under appropriate conditions. Formulation F2, with a 2:1 weight ratio of isopropanol to water, appears to give optimal combination of gelatin swelling and solubility of the photoinitiator, so that good performance is obtained on substrate C2 with only 208 mg/ft$^2$ of HMP. However, the performance with this formulation can be improved by using a higher level of HMP in the substrate; thus, the combination of C3 with F2 also gives good performance. Alternatively, higher levels of the crosslinkable monomer can be used (Formulation F3). This example therefore shows that there is a reasonably wide range of combination of coating composition and overcoat formulation under which a good protective overcoat may be obtained.

Example 3

Coating melts containing photoinitiator as in Table 2 were prepared, except using Dispersions D3 (BME photoinitiator) and D4 (BIBE photoinitiator). Coatings C4 through C12 were prepared by application of these melts to the color paper substrate S1 as single layer coatings as described in Example 1, with coating laydowns as shown in Table 6 below. As before, BVSM was used as a hardener, at a level of 1.8% w/w with respect to the total gelatin in the coating.

TABLE 6

| Coating No. | Gelatin Laydown mg/ft$^2$ | Source of Photoinitiator | Photoinitiator Laydown mg/ft$^2$ |
|---|---|---|---|
| C4 Control | 100 | None | 0 |
| C5 | 100 | D4 | 18 |
| C6 | 100 | D4 | 36 |
| C7 | 100 | D4 | 63 |
| C8 | 100 | D4 | 90 |
| C9 | 100 | D3 | 18 |
| C10 | 100 | D3 | 36 |
| C11 | 100 | D3 | 63 |
| C12 | 100 | D3 | 90 |

Small samples of coatings C4 through C12 were spin-coated as described in Example 2 with the Formulation F2 of Example 1. The coating conditions (1000 rpm) gave a coating thickness after solvent evaporation of about 1.5 microns. The overcoated samples were cured by exposure to 300 mJ/cm$^2$ of UV irradiation. The coatings were evaluated for degree of cure and stain resistance as described in Example 2, with results summarized in Table 7 below.

TABLE 7

| Coating | Photoinitiator (Dispersion) | | Degree of cure | Water (stain) resistance |
|---|---|---|---|---|
| C4 | none | Control | NC | D |
| C5 | 18 mg/ft$^2$ BIBE (D4) | Invention | D | B |
| C6 | 36 mg/ft$^2$ BIBE (D4) | Invention | A | C |
| C7 | 63 mg/ft$^2$ BIBE (D4) | Invention | A | B |
| C8 | 90 mg/ft$^2$ BIBE (D4) | Invention | A | B |
| C9 | 18 mg/ft$^2$ BIBE (D3) | Invention | D | C |
| C10 | 36 mg/ft$^2$ BIBE (D3) | Invention | A | B |
| C11 | 63 mg/ft$^2$ BIBE (D3) | Invention | A | B |
| C12 | 90 mg/ft$^2$ BIBE (D3) | Invention | A | B |

Even with only 18 mg/ft$^2$ of the photoinitiator in the support, some degree of crosslinking can be obtained under these conditions using either a loaded latex dispersion (D4) of BIBE or a gelatin-stabilized oil-in-water dispersion (D3). All of the higher levels of photoinitiator yielded coatings that completely crosslinked the photopolymerizable monomer in the overcoat, and yielded a hard, relatively water-impermeable protective layer.

Example 4

In another series of experiments, samples of Coatings C4 through C12 used in Example 3 were subjected to the Kodak RA-4 photographic processing. The coatings were then spin coated and cured as before. The results after photographic processing are shown in Table 8 below.

TABLE 8

| Coating | | Degree of cure | Water (stain resistance) | Wiping Damage |
|---|---|---|---|---|
| C4 | Control | NC | D | C |
| C5 | Comparison | NC | D | C |
| C6 | Invention | A | D | C |
| C7 | Invention | A | B | B |
| C8 | Invention | A | B | A |
| C9 | Comparison | NC | D | C |
| C10 | Invention | NC | C | C |
| C11 | Invention | A | B | A |
| C12 | Invention | A | B | A |

Some of the photoinitiator is removed during the photographic processing of these coatings, so that at lower coating levels, there is not enough to give optimal and efficient crosslinking of the overcoat. However, with either type of dispersion, enough photoinitiator remains at coating levels greater than about 40 mg/f$^2$ to obtain an optimally durable, substantially water impermeable, protective layer. This example therefore demonstrates that the invention is compatible with conventional photoprocessing.

Example 5

Formulation F4 is a 5% suspension in water of Polymer P2, a butyl methacrylate/vinylidine chloride/itaconic acid (49:49:2 weight ratio) latex polymer alone. Formulation F5 is a formulation of P2 loaded with 25% pentaerythritol tetraacrylate (5% total solids). Samples of Coatings C4 (control), C8, and C12 were subjected to the Kodak RA-4 photographic development process and then overcoated by spray coating with the a 5. The dried coatings were exposed to ca. 600 mJ/ft$^2$ of UV irradiation, and tested for water and fingerprint resistance. The results are shown in Table 9.

TABLE 9

| Coating | | Water (stain) resistance | Fingerprint Resistance |
|---|---|---|---|
| C4 + F4 | Control | D | A |
| C4 + F5 | Comparison | D | A |
| C8 + F5 | Invention | A | A |
| C12 + F5 | Invention | A | A |

The control sample coated with the latex alone gives poor water resistance because the latex does not form a continuous film. Incorporation of the tetraacrylate does not soften the latex sufficiently to allow it to form a film. However, coating the loaded latex over a support containing the photocrosslinking catalyst allows a durable, continuous film to be formed that is impermeable to water. The resistance to fingerprints is good in all cases with this polymeric overcoat, and is not degraded by the addition of the tetraacrylate, or by exposure to light.

The invention has been described in detail with particular reference to certain preferred embodiments thereof, but it will be understood that variations and modifications can be effected within the spirit and scope of the invention.

What is claimed is:

1. A method of making an imaged element with a protective overcoat over the image, the method comprising:

(a) providing an imaging element comprising a support and at least one imaging layer superposed on a side of said support, wherein a curing agent is incorporated into a layer near the top surface of the element such that the curing agent can effectively diffuse into an overcoat when applied over an image formed in the imaging layer;

(b) forming a dye-based or pigment-based photographic or digital pictorial image in the at least one imaging layer to form an imaged layer;

(c) applying over the imaged layer an overcoat composition having a dry laydown of at least 0.54 g/m$^2$ (50 mg/ft$^2$) comprising a curable material; and (d) allowing the curing agent to effectively diffuse into the applied overcoat, thereby forming a cured water-resistant overcoat, optionally with the addition of heat or actinic radiation.

2. The method of claim 1 wherein the curing agent is loaded into a latex that is incorporated into the imaging element.

3. The method of claim 1 wherein the curing agent is incorporated into the imaging layer as an oil-in-water emulsion.

4. The method of claim 1 wherein the curing agent is a photoinitiator and the overcoat composition is cured by UV radiation to crosslink the curable material.

5. The method of claim 1, wherein the imaged element is a photographic print and the image is formed in a developer solution having a pH greater than 7.

6. The method of claim 1 wherein the curable material comprises a multifunctional monomer.

7. The method of claim 6 wherein the curable material is a multifunctional acrylate.

8. The method of claim 1 wherein the curable material is a crosslinkable polymer.

9. The method of claim 1 wherein the overcoat composition comprises an aqueous water-dispersible latex that is principally a polymer selected from the group consisting of polyesters, polyamides, polyimides, polyurethanes, polyureas, polyethers, polycarbonates, polyacid anhydrides, polymers derived from vinyl ethers, vinyl heterocyclic compounds, styrenes, olefins, halogenated olefins, unsaturated acids and esters thereof, unsaturated nitriles, vinyl alcohols, acrylamides and methacrylamides, and vinyl ketones, poly(epoxides) and copolymers formed from various combinations of the corresponding monomers, and combinations thereof.

10. The method of claim 9 wherein said aqueous water-dispersible latex is principally a polymer that is the reaction product of a mixture of monomers comprising one or more monomers selected from the group consisting of alkyl esters of acrylic or methacrylic acid, hydroxyalkyl esters of the same acids, the nitrile and amides of the same acids, vinyl acetate, vinyl propionate, vinylidene chloride, vinyl chloride, and vinyl aromatic compounds.

11. The method of claim 1 wherein said curing agent is selected from the group consisting of hydroxymethylpropiophenone, benzophenone, benzoin, and benzoin ether compounds.

12. The method of claim 1 wherein the image in the imaged layer is formed by an ink-jet printing process.

13. The method of claim 1 in wherein the curable material comprises a photopolymerizable multifunctional monomer.

14. The method of claim 1 wherein the overcoat is applied by means of a wire-wound roller or other metering device.

15. The method of claim 1 wherein the overcoat is applied by means of spray coating.

16. The method of claim 1 in wherein the overcoat composition used to form the protective overcoat comprises 5 to 75% by weight water.

17. The method of claim 1 wherein the imaged element is a photographic print and the curing agent has a water solubility, as measured by the logP value, of between 3 and 12.

18. The method of claim 1 wherein the imaged element is a photographic print and the curing agent has a water solubility, as measured by the logP value, of between 4 and 9.

19. The method of claim 1 wherein the overcoat composition further comprises UV absorbers, surfactants, emulsifiers, coating aids, lubricants, matte particles, rheology modifiers, crosslinking agents, antifoggants, inorganic fillers, pigments, magnetic particles and/or biocides.

20. A method of making a photographic print with a water-resistant overcoat, comprising the steps of:

(a) providing a photographic element comprising a support, at least one silver-halide emulsion layer superposed on a side of said support, wherein a curing agent is incorporated into a top layer of the element such that it is effectively diffusible into an aqueous overcoat when applied over the emulsion layer;

(b) image-wise exposing the photographic element;

(c) developing the photographic element in a developer solution having a pH greater than 7 to obtain the photographic print; and (d) applying a protective overcoat having a laydown of at least 0.54 g/m$^2$ (50 mg/ft$^2$) made from an overcoat composition comprising 0.45 to 6.0 g/m$^2$ (about 45 to 600 mg/ft$^2$) dry laydown of a curable material;

(e) allowing the curing agent to effectively diffuses into the applied overcoat, thereby forming a water-resistant cured overcoat, optionally with the use of heat or actinic radiation.

21. The method of claim 20 wherein the overcoat composition comprises a water-dispersible latex of a hydrophobic polymer in the form of particles having an average particle size of 10 to 250 nm in combination with a photopolymerizable curable component comprising 20 to 300 weight percent, with respect to the hydrophobic polymer, of copolymerizable compatible monomers, at least one of which monomers is a multifunctional monomer having more than one polymerizable ethylenic unsaturation, wherein the Tg of the coated composition comprising the latex particles and the photopolymerizable component system prior to crosslinking is −60 to 60° C.

* * * * *